US007125637B2

(12) United States Patent
Ohmura et al.

(10) Patent No.: US 7,125,637 B2
(45) **Date of Patent: *Oct. 24, 2006**

(54) TONER FOR DEVELOPING ELECTROSTATIC LATENT IMAGE, IMAGE FORMING METHOD AND IMAGE FORMING APPARATUS

(75) Inventors: Ken Ohmura, Hachioji (JP); Hiroshi Yamazaki, Hachioji (JP); Asao Matsushima, Hachioji (JP); Shiro Hirano, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 208 days.

This patent is subject to a terminal disclaimer.

(21) Appl. No.: 10/760,683

(22) Filed: Jan. 20, 2004

(65) Prior Publication Data

US 2005/0158647 A1 Jul. 21, 2005

(51) Int. Cl.
*G03G 9/087* (2006.01)

(52) U.S. Cl. ..... 430/110.3; 430/110.4

(58) Field of Classification Search ..... 430/110.3, 430/110.4

See application file for complete search history.

(56) References Cited

U.S. PATENT DOCUMENTS 6,475,689 B1 * 11/2002 Yamazaki et al. ..... 430/108.4
6,844,126 B1 * 1/2005 Ohmura et al. ..... 430/110.3

* cited by examiner

*Primary Examiner*—Mark A. Chapman
(74) *Attorney, Agent, or Firm*—Lucas & Mercanti, LLP

(57) ABSTRACT

In a toner for developing electrostatic latent images, average circularity is 0.94–0.98, the average value of the equivalent circular diameter is 2.6–7.4 μm and the gradient of the circularity to the equivalent circular diameter is from −0.005 to −0.001, and an image forming method using the same.

20 Claims, 2 Drawing Sheets

TONER FOR DEVELOPING ELECTROSTATIC LATENT IMAGE, IMAGE FORMING METHOD AND IMAGE FORMING APPARATUS

BACKGROUND

The present invention relates to a toner for developing electrostatic latent images, and an image forming method and an image forming apparatus employing the same.

In recent years, along with development of digital image processing technology, in image forming methods utilizing an electrostatic latent image development system such as an electrophotographic system, digital system image formation has become mainstream.

In image forming methods utilizing the digital systems, an image comprised of dots as small as 1,200 dpi (dots per inch or the number of dots per 2.54 cm) is basically visualized, and high image quality technology is required which faithfully reproduces such minute dot image.

In order to effectively produce such high quality images, a decrease in the diameter of toner particles for developing electrostatic latent images has been carried out. In image formation utilizing an electrostatic latent image developing system such as an electrophotographic system, heretofore, a so-called pulverized toner, prepared as described below, has been mainly employed. Binder resins and pigments are mixed and kneaded. Powder prepared by pulverizing the resulting mixture is then classified by size. However, toner which is prepared employing such processes is limited in the decrease in the diameter of toner particles and uniform particle size distribution. Difficulties are accompanied to achieve a decrease in the diameter of toner particles, uniformity of the size distribution, as well as the particle shape. Consequently, it is difficult to sufficiently achieve higher image quality for images prepared by an electrophotographic system employing such pulverized toners.

In recent years, as means to achieve a decrease in the diameter of toner particles and uniformity of particle size distribution as well as the shape, polymerization method toners prepared employing a suspension polymerization method or an emulsion polymerization method have received increasing attention. These polymerization toners are prepared in such a manner that a dispersion prepared by uniformly dispersing monomers as a raw material in a water-based system undergoes polymerization to form toner. Several methods are feasible. Of these, the method which receives the highest attention is one in which resinous particles, prepared employing a suspension polymerization method or an emulsion polymerization method as well as colorant particles, are subjected to coalescence (salting-out and fusion). The aforesaid method has been studied for practical use but the aspect of its production engineering is still in the stage of development.

On the other hand, widely employed as a system for fixing toner images formed on an image forming support (being a transfer material) such as a paper sheet is a heating roller fixing system in which fixing is carried out by allowing the aforesaid image forming support carrying images to pass between a heating roller and a pressure roller.

However, when the heating roller fixing system is employed in combination with the polymerization method toner in which toner particles have a small diameter and the particle size distribution as well as the shape is uniform, problems occur in which since toner particles are not capable of being sufficiently deformed to conform to the unevenness of the paper and the heating roller surface, insufficient fixing results.

SUMMARY

It is possible to overcome the above-mentioned problems by employing the constitution and method described below.

Toner for developing electrostatic latent images comprising the circularity of 0.94–0.98, the average value of equivalent circular diameter of 2.6–7.4 μm, and the gradient of the circularity to the equivalent circular diameter of from −0.005 to −0.001.

In order to form an electrostatic latent image formed on a photoreceptor to a toner image, an image forming method comprising a development process employing the aforesaid toner, a process which transfers the aforesaid toner image onto a recording medium, and a process which fixes the aforesaid toner image.

In the aforesaid constitution and method, even though the heating roller fixing system is employed in combination with a polymerization method toner in which the diameter of toner particles is relatively small and the particle size distribution and the particle shape are uniform, toner particles are sufficiently deformed to conform to unevenness of paper sheets and the heating roller surface, whereby it is possible to form high quality images while minimizing insufficient fixing.

Production methods of the toner for developing electrostatic latent images of the present invention are not particularly limited. However, preferred is a so-called polymerization method, namely a method in which at least polymerizable monomers are polymerized in a water-based medium to result in toner particles. Further, toner particles are preferred which are prepared by salting out/coalescing the resulting resinous particles in a water-based medium. The reason for this is that by salting out/coalescing resinous particles prepared employing the polymerization method, it is possible to prepare small diameter toner particles of which particle size distribution and shape are controlled.

Regarding the shape of toner particles of the present invention, the average circularity (shape factor) represented by the formula described below is preferably 0.94–0.98, and is more preferably 0.95–0.97.

$$\text{Average circularity} = (\text{equivalent circular diameter}) / (\text{peripheral length of particle projected image})$$

Incidentally, the aforesaid average circularity can be determined employing FPIA-2100 (manufactured by Sysmex Corp.

$$\text{Equivalent circular diameter} = 2\pi(\text{sum of particle area}/\pi)^{1/2}$$

Further, it is characterized that the average value of the equivalent circular diameter is 2.6–7.4 μm, and gradient of the circularity to the equivalent circular diameter is from −0.005 to −0.001. It is more preferable that the average value of the equivalent circular diameter is 3.4–6.6 μm, and gradient of the circularity to the equivalent circular diameter is from −0.004 to −0.002.

The gradient of the circular equivalent diameter may be determined as follows. The equivalent circular diameter for every 10 percent of the cumulative number of toner particles is determined employing a flow system particle image analyzer FPIA-2100, and the relationship with the circularity corresponding to each of them is drawn by plotting a equivalent circular diameter (μm) as an abscissa and circularity as an ordinate, whereby a linear relationship ($y=\alpha x+b$) is obtained (wherein $\alpha$ represents the gradient of the equivalent circular diameter).

At that time, in view of enhancing uniformity of charge and halftone, $R^2$ is preferably 0.35–0.95, wherein R is represented by the following Formula 1.

$$R = \frac{n(\sum XY) - (\sum X \sum Y)}{[n\sum X^2 - (\sum X)^2][n\sum Y^2 - (\sum Y)^2]} \quad \text{(Formula 1)}$$

wherein X represents the equivalent circular diameter and Y represent the circularity.

Further, in order to prepare toner having the desired gradient of the equivalent circular diameter, non-spherical toner particles of a larger particle diameter may be blended with spherical toner particles of a relatively small particle diameter. Alternatively, in the method described below in which toner particles are prepared by coalescing resinous particles, a method may be employed in which, after the addition of coagulants in the coalescence process, conditions are set so that shearing force is easily applied to relatively large particles while suitably selecting the shape of stirring blades and controlling the rate of stirring, and the resulting toner particles are transferred to filtration and drying processes.

After charging termination agents, which terminate salting-out/coalescence, when toner particles have grown to 0.2–1.0 μm, it is possible to control the parameters to remain in the range specified by the present invention.

Further, in the present invention, in view of equalizing the surface charge amount of toner particles, ratio $d_{90}/d_{10}$ is preferably 1.2–1.8, wherein $d_{10}$ represents the equivalent circular diameter at cumulative 10 percent of the toner and $d_{90}$ represents the equivalent circular diameter at cumulative 90 percent. When controlled to remain in this range, it is possible to control minute spots around dots, whereby it is possible to produce high quality images with enhanced uniformity of halftone.

Further, it is preferable that minute silica particles are added as an external additive. In such cases, in view of humidity dependence of charge, namely minimizing variation of image quality due to humidity, it is preferable that BET specific surface area of toner particles is 1.1–4.0 $m^2/g$, the amount of silicon atoms on the surface, determined by ESCA, is 6–12 percent by area, and the amount of carbon atoms is 50–75 percent by area.

DETAILED DESCRIPTION OF THE PREFERRED EMBODIMENT

Figure 1:
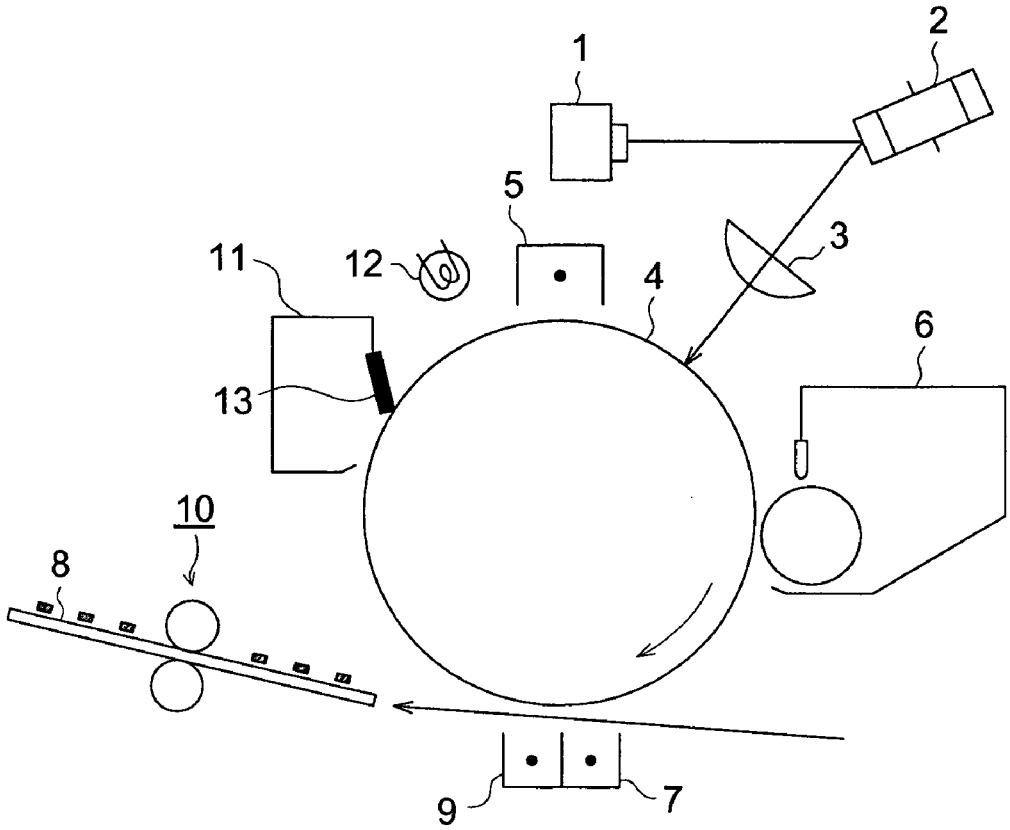
FIG. 1 is a schematic view showing one example of the image forming method and image forming apparatus of the present invention.

In production methods of the toner of the present invention, listed as preferably employed methods in which particles are prepared in a water-based media may be methods described, for example, in Japanese Patent Publication Open to Public Inspection Nos. 63-186253, 63-282749, and 7-146583, as well as a method in which toner is prepared by salting-out/coalescing resinous particles.

It is preferable that resinous particles employed for the production of the toner of the present invention are those at a weight average particle diameter of 50–2,000 nm. These resinous particles may be prepared employing any of the granulation polymerization methods such as emulsion polymerization, dispersion polymerization, or suspension polymerization. Preferably, resinous particles are employed which are prepared by emulsion polymerization employing the emulsion polymerization method.

Materials for resinous particles as well as examples of the production methods will now be described.

<<Materials>>

(Monomers)

Employed as polymerizable monomers are radical polymerizable monomers as an essential component, and if desired, crosslinking agents may be employed. Further, it is preferable that at least one of the acidic group- or basic group-containing monomers, described below, is incorporated.

(1) Radical Polymerizable Monomers

Radical polymerizable monomer components are not particularly limited, and any of the conventional radical polymerizable monomers, known in the art, may be employed. Further, they may be employed individually or in combinations of at least two types to satisfy the required characteristics.

Specifically, it is possible to use aromatic vinyl monomers, (meth)acrylic acid ester based monomers, vinyl ester based monomers, vinyl ether based monomers, monoolefin based monomers, diolefin based monomers, and halogenated olefin based monomers.

Listed as aromatic vinyl monomers are, for example, styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecyl styrene, 2,4-dimethylstyrene, or 3,4-dichlorostyrene.

Listed as (meth)acrylic acid ester based monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, and diethyl aminoethyl methacrylate.

Listed as vinyl ester based monomers are vinyl acetate, vinyl propionate, and vinyl benzoate.

Listed as vinyl ether based monomers are vinyl methyl ether, vinyl ethyl ether, vinyl isobutyl ether, and vinyl phenyl ether.

Listed as monoolefin based monomers are ethylene, propylene, isobutylene, 1-butene, 1-pentane, and 4-methyl-1-pentane.

Listed as diolefin based monomers are butadiene, isoprene, and chloroprene.

Listed as halogenated olefin based monomers are vinyl chloride, vinylidene chloride, and vinyl bromide.

(2) Crosslinking Agents

In order to improve toner characteristics, added may be radical polymerizable crosslinking agents as a crosslinking agent. Listed as such radical polymerizable crosslinking agents are those having at least two unsaturated bonds such as divinylbenzene, divinylnaphthalene, divinyl ether, diethylene glycol methacrylate, ethylene glycol dimethacrylate, polyethylene glycol dimethacrylate, or diallyl phthalate.

(3) Acidic Group- or Basic Group-Containing Radical Polymerizable Monomers

Employed as acidic group- or basic group-containing radical polymerizable monomers are, for example, carboxyl group-containing monomers, sulfonic acid group-containing monomers, as well as amine based compounds such as primary, secondary, tertiary, or quaternary ammonium salts.

Listed as acidic group-containing radical polymerizable monomers are, as carboxylic acid-containing monomers, acrylic acid, methacrylic acid, fumaric acid, maleic acid, itaconic acid, cinnamic acid, maleic acid monobutyl ester, and maleic acid monooctyl ester.

Listed as sulfonic group-containing monomers are styrenesulfonic acid, allylsulfosuccinic acid, and octyl allylsulfosuccinate.

These compounds may be structured as salts of alkali metals such as sodium or potassium, or salts of alkali earth metals such as calcium.

Listed as basic group-containing radical polymerizable monomers may be amine based compounds such as dimethyl aminoethyl acrylate, dimethyl aminoethyl methacrylate, diethyl aminoethyl acrylate, diethyl aminoethyl methacrylate, and quaternary ammonium salts of the above-mentioned four compounds, 3-dimethylaminophenyl acrylate, 2-hydroxy-3-methacryloxypropyltrimethyl ammonium salt, acrylamide, N-butylacrylamide, N,N-dibutylacrylamide, piperidylacrylamide, methacrylamide, N-butylmethacrylamide, N-octadecylacrylamide, vinylpyridine, vinylpyrrolidone, vinyl N-methylpyridinium chloride, vinyl N-ethylpyridinium chloride, N,N-diallylmethylammonium chloride, and N,N-diallylethylammonium chloride.

When radical polymerizable monomers are employed in the present invention, the used amount of acidic group-containing radical polymerizable monomers or basic group-containing radical polymerizable monomers is preferably 0.1–15 percent by weight of the total monomers. The used amount of radical polymerizable crosslinking agents is preferably in the range of 0.1–10 percent by weight with respect to the total radical polymerizable monomers, even though the used amount varies depending on their characteristics.

(Chain Transfer Agents)

For the purpose of controlling molecular weight, it is possible to use common chain transfer agents.

Chain transfer agents are not particularly limited. For example, employed are mercaptans such as octylmercaptan, dodecylmercaptan, or tert-dodecylmercaptan, carbon tetrabromide, and styrene dimers.

(Polymerization Initiators)

Radical polymerization initiators employed in the present invention are suitably used if they are water-soluble. Examples include persulfates (potassium persulfate and ammonium persulfate), azo based compounds (4,4'-azobis-4-cyanovaleric acid and its salts, and 2,2'-azobis(2-amidinopropane) salts), and peroxide compounds.

The polymerization temperature may be any temperature as long as it is equal to or more than the lowest radical formation temperature of polymerization initiators. For example, temperature in the range of 50–90° C. is employed. However, by utilizing combinations such as hydrogen peroxide-reducing agents (such as ascorbic acid) in which the polymerization initiator achieves initiation at normal temperature, it is possible to conduct polymerization at room temperature or higher.

(Surface Active Agents)

In order to conduct polymerization employing the aforesaid radical polymerizable monomers, it is necessary to disperse those monomers into a water-based medium in the form of oil droplets, employing surface active agents. Surface active agents which can be employed for the aforesaid dispersion are not particularly limited. Listed as suitable surface active agents may be any of the ionic surface active agents described below.

Listed as ionic surface active agents are sulfonic acid salts (sodium dodecybenzenesulfonate, sodium arylalkylpolyethersulfonate, sodium 3,3-disulfodiphenylurea-4,4-diazo-bis-amino-8-naphthol-6-sulfonate, and sodium ortho-carboxybenzene-azo-dimethylaniline-2,2,5,5-tetramethyltriphenylmethane-4,4-diazo-bis-β-naphthol-6-sulfonate), sulfuric acid esters (sodium dodecylsulfate, sodium tetradecylsulfate, sodium pentadecyl sulfate, and sodium octylsulfate), and fatty acid salts (sodium oleate, sodium laurate, sodium caprate, sodium caprylate, sodium caprorate, potassium stearate, and calcium oleate).

Further, it is also possible to use nonionic surface active agents. Listed as specific examples may be polyethylene oxides, polypropylene oxides, combinations of polyethylene oxides with polypropylene oxides, ethyl esters of higher fatty acids with polyethylene glycol, alkylphenol polyethylene oxides, esters of polyethylene glycol with higher fatty acids, esters of polypropylene oxides with higher fatty acids, and sorbitan esters.

In the present invention, these surface active agents are employed mainly as emulsifiers during emulsion polymerization, however they may also be employed in other processes or for other purposes.

(Colorants)

Listed as colorants may be inorganic and organic pigments, as well as dyes.

Employed as inorganic pigments may be those known in the art. Specific inorganic pigments are exemplified below.

Employed as black pigments are, for example, carbon black such as furnace black, channel black, acetylene black, thermal black, or lamp black, as well as magnetic powders such as magnetite or ferrite.

If desired, these inorganic pigments may be employed individually or in combinations of a plurality of selected ones. Further, the added amount of the pigments is customarily 2–20 percent by weight with respect to the polymers, and is preferably 3–15 percent by weight.

When toner is used as a magnetic toner, it is possible to add the aforesaid magnetites to the toner. In such cases, in view of providing specified magnetic characteristics for the toner, the added amount in the toner is preferably 20–60 percent by weight.

Employed as organic pigments and dyes may be any of those known in the art. Specific organic pigments and dyes are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 180, C.I. Pigment Yellow 185, C.I. Pigment Yellow 155, and C.I. Pigment Yellow 156.

Listed as pigments for green or blue are C.I. Pigment Blue 15, C.I. Pigment Blue 15:2, C.I. Pigment Blue 15:3, C.I. Pigment Blue 16, C.I. Pigment Blue 60, and C.I. Pigment Green 7.

Employed as dyes may be C.I. Solvent Red 1, the same 49, the same 52, the same 58, the same 63, the same 111, and the same 122, Solvent Yellow 19, the same 44, the same 77, the same 79, the same 81, the same 82, the same 93, the same 98, the same 103, the same 104, the same 112, the same 162, and Solvent Blue 25, the same 36, the same 60, the same 70, the same 93 and the same 95. It is also possible to use mixtures thereof.

If desired, these organic pigments and dyes may be used individually or in combinations of a plurality of selected ones. Further, the added amount of pigments is customarily 2–20 percent by weight, and is preferably 3–15 percent by weight.

Colorants may be subjected to surface modification and then employed. Employed as the surface modifying agents may be any of those known in the art. Specifically, silane coupling agents, titanium coupling agents, and aluminum coupling agents are preferably employed.

<<Production Process>>

The production process of the polymerization toner of the present invention is comprised of a process, in which a monomer solution in which release agents are dissolved, is dispersed into a water-based medium, and subsequently resinous particles incorporating the aforesaid release agents are prepared employing a polymerization method, a process in which, employing the aforesaid resinous particle dispersion, resinous particles are coalesced in a water-based medium, a process in which the resulting particles are collected by filtration to remove surface active agents and the like, a process in which the resulting particles are dried, and a process in which external additives are added to the resulting dried particles; these resinous particles may be colored. Further, non-colored particles may also be employed as resinous particles. In such cases, after adding a colorant particle dispersion to the resinous particle dispersion, colored particles may be prepared by coalescing the resulting mixture in a water-based dispersion.

Particularly preferred as a coalescing method is a salting-out/coalescing method employing resinous particles prepared via a polymerization process. Further, when non-colored resinous particles are employed, it is possible to salt out/coalesce resinous particles and colorant particles in a water-based medium.

Further, in addition to colorants and release agents, charge control agents and the like, which are components constituting toner may also be incorporated in the form of particles.

Water-based media, as described herein, are comprised of water as a main component and indicate that the content of water is at least 50 percent by weight. Other than water, listed may be water-soluble organic solvents. Listed, for example, may be methanol, ethanol, isopropanol, butanol, acetone, methyl ethyl ketone, and tetrahydrofuran, and preferred are organic solvents which do not dissolve resins. Particularly preferred are alcohol based organic solvents such as methanol, ethanol, isopropanol or butanol.

Listed as a preferable polymerization method in the present invention may be a method in which water-soluble polymerization initiators are added to a dispersion which is prepared by mechanically dispersing, in the form of oil droplets, a monomer solution prepared by dissolving release agents in the monomers into a water-based medium in which surface active agents are dissolved at a concentration of at most critical micelle concentration. In this case, oil-soluble polymerization initiators may be added to the monomers and subsequently used.

Homogenizers to achieve oil-droplet dispersion are not particularly limited. For example, listed may be Clearmix, ultrasonic homogenizers, mechanical homogenizers, and Manton-Gaulin and pressure homogenizers.

There is a method in which colorant particles are prepared by dispersing colorants into a water-based medium. The aforesaid dispersion is carried out in such a state that the concentration of the surface active agent exceeds the critical micelle concentration (CMC) of the surface active agent in water.

Homogenizers employed during pigment dispersion are not particularly limited. However, preferably listed are Clearmix, ultrasound homogenizers, mechanical homogenizers, pressure homogenizers such as Manton Gaulin or other pressure type homogenizers, sand grinders, and medium type homogenizers such as a Getzmann mill or a diamond fine mill.

Employed as surface active agents used herein may be any of those described above.

(Salting-Out/Coalescing Process)

In a process which achieves salting-out/coalescence, salting-out agents are added, as a coagulant in an amount to arrive at a concentration higher than the critical coagulation concentration, to water in which resinous particles and colorant particles are present, and subsequently, by heating the resulting mixture to a temperature higher than the glass transition point of the resinous particles, salting-out is allowed to proceed while coalescence is simultaneously achieved.

Herein, listed as salting-out agents are, as metals, lithium, potassium, sodium, magnesium, calcium, strontium, barium, aluminum, and titanium. Listed as formed salts are chlorides, bromides, iodides, carbonates, and sulfates.

When the salting-out/coalescence of the present invention is performed, standing time after adding salting-out agents is controlled through monitoring the resulting shape factor, and it is preferable to keep the standing time as short as possible. The temperature for adding the aforesaid salting-out agents is not particularly limited, however it is preferably 80–90° C.

Further, in the present invention, it is preferable to use a method in which the dispersion of resinous particles is heated as quickly as possible so that the resinous particles are heated to be equal to or higher than the glass transition temperature. Time for achieving the aforesaid temperature rise is customarily less than 30 minutes, but is preferably less than 10 minutes. Further, since it is necessary to quickly raise the temperature, the rate of temperature rise is preferably at least 1° C./minute. Even though the upper limit is not particularly clarified, in view of retarding the formation of coarse particles due to rapid salting-out/coalescence, the rate is preferably at most 15° C./minute. Listed as a particularly preferable embodiment is a method in which salting-out/coalescence is allowed to continue even after the temperature exceeds the glass transition temperature. By utilizing the aforesaid method, it is possible to effectively proceed with the growth of particles as well as the coalescence, whereby it is possible to enhance the particle strength as well as the durability of the finished toner.

It is preferable that release agents are incorporated into the particles of the toner of the present invention. By employing a toner which has been prepared by salting out/coalescing resinous particles comprising release agents, it is possible to uniformly incorporate the release agents into a toner particle, and further to form toner particles in which the release agents are incorporated into the location near the particle surface.

By salting out/coalescing resinous particles into which release agents are incorporated and colorant particles in a water-based medium, it is possible to prepare toner in which the release agents are finely dispersed.

Preferred as release agents are compounds represented by the general formula described below.

$$R^1—(OCO—R^2)_n$$

In the above general formula, n is an integer of 1–4, is preferably 2–4, is more preferably 3–4, and is most preferably 4.

$R^1$ and $R^2$ each represent a hydrocarbon group which may have a substituent.

The number of carbon atoms in $R^1$ is customarily 1–40, is preferably 1–20, and is still more preferably 2–5.

The number of carbon atoms in $R^2$ is customarily 1–40, is preferably 16–30, and is still more preferably 18–26.

Representative exemplified compounds will now be described.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—CH(CH_3)—CH_2—O—CO—(CH_2)_{22}—CH_3$

9) $CH_3—(CH_2)_{26}—COO—CH_2—CH(CH_3)—CH_2—O—CO—(CH_2)_{26}—CH_3$

-continued

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

12) $CH_2—OH$
$CH—O—CO—(CH_2)_{26}—CH_3$
$CH_2—O—CO—(CH_2)_{26}—CH_3$

13) $CH_2—OH$
$CH—O—CO—(CH_2)_{22}—CH_3$
$CH_2—O—CO—(CH_2)_{22}—CH_3$

14) $CH_2—OH$
$CH—OH$
$CH_2—O—CO—(CH_2)_{26}—CH_3$

15) $CH_2—OH$
$CH—OH$
$CH_2—O—CO—(CH_2)_{22}—CH_3$

16) $CH_3—(CH_2)_{26}—COO—CH_2—C(CH_3)(CH_2—O—CO—(CH_2)_{26}—CH_3)(CH_2—O—CO—(CH_2)_{26}—CH_3)$

17) $CH_3—(CH_2)_{20}—COO—CH_2—C(CH_2CH_3)(CH_2—O—CO—(CH_2)_{20}—CH_3)(CH_2—O—CO—(CH_2)_{20}—CH_3)$

18) $CH_3—(CH_2)_{26}—COO—CH_2—C(CH_2—O—CO—(CH_2)_{26}—CH_3)(CH_2—O—CO—(CH_2)_{26}—CH_3)(CH_2—O—CO—(CH_2)_{26}—CH_3)$

19) $CH_3—(CH_2)_{20}—COO—CH_2—C(CH_2—O—CO—(CH_2)_{20}—CH_3)(CH_2—O—CO—(CH_2)_{20}—CH_3)(CH_2—O—CO—(CH_2)_{20}—CH_3)$

20) $CH_3—(CH_2)_{18}—COO—CH_2—C(CH_2—O—CO—(CH_2)_{18}—CH_3)(CH_2—O—CO—(CH_2)_{18}—CH_3)(CH_2—O—CO—(CH_2)_{18}—CH_3)$

21) $CH_3—(CH_2)_{16}—COO—CH_2—C(CH_2—O—CO—(CH_2)_{16}—CH_3)(CH_2—O—CO—(CH_2)_{16}—CH_3)(CH_2—O—CO—(CH_2)_{16}—CH_3)$

-continued

22)

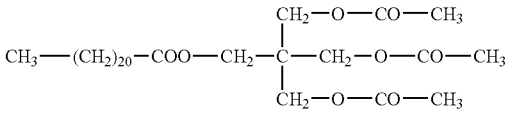

The added amount is commonly 1–30 percent by weight with respect to the total amount of toner, and is preferably 3–25 percent by weight.

Other than colorants and release agents, materials which provide various functions may be added to toner as a toner material. Addition of these components may be carried out during the aforesaid salting-out/coalescing stage, while employing various methods such as a method in which these are incorporated into toner or a method in which these are added to the resinous particles themselves.

It is also possible to use various charge control agents, known in the art, which can be dispersed into water. Specifically listed are quaternary ammonium salt compounds, fluorine based compounds, azo based metal complexes, as well as salicylic acid metal salts or metal complexes thereof.

<<External Additives>>

For the purpose of improving fluidity and chargeability as well as enhancing the cleaning property, the toner of the present invention may be employed while incorporating so-called external additives. These external additives are not particularly limited, and it is possible to use various kinds of minute inorganic and organic particles as well as lubricants.

As minute inorganic particles, it is possible to use those known in the art. Specifically, it is possible to preferably use minute particles of silica, titanium, and alumina. It is preferable that these minute inorganic particles are hydrophobic. Specifically listed as minute silica particles are, for example, commercially available products such as R-805, R-976, R-974, R-972, R-812, and R-809, manufactured by Nippon Aerosil Co. Ltd., HVK-2150 and H-200, manufactured by Hoechst Co., and TS-720, TS-530, TS-610, H-5, and MS-5, manufactured by Cabot Corp.

Listed as minute titanium particles are, for example, commercially available products such as T-805 and T-604, manufactured by Nippon Aerosil Corp., MT-100S, MT-100B, MT-500BS, MT-600, MT-600SS, and JA-1, manufactured by TAYCA Corp., TA-300SI, TA-500, TAF-130, TAF-510, and TAF-510T, manufactured by Fuji Titanium Industry Co. Ltd., and IT-S, IT-OA, IT-OB, and IT-OC, manufactured by Idemitsu Kosan Co., Ltd.

Listed as minute alumina particles are, for example, commercially available products such as RFY-C and C-604, manufactured by Nippon Aerosil Co., Ltd. and TTO-55, manufactured by Ishihara Sangyo Kaisha Ltd.

Further, employed as minute organic particles may be minute spherical organic particles of a number average primary particle diameter of 10–2,000 nm. Employed as such particles may be homopolymers of styrene or methyl methacrylate and copolymers thereof.

Listed as lubricants are, for example, metal salts of higher fatty acids, such as stearic acid salts of zinc, aluminum, copper, magnesium, and calcium, oleic acid salts of zinc, manganese, iron, copper, and magnesium, palmitic acid salts of zinc, copper, magnesium, and calcium, linoleic acid salts of zinc and calcium, and ricinolic acid salts of zinc and calcium.

The added amount of these external additives is preferably 0.1–5 percent by weight with respect to the toner. Addition of external additives may be carried out employing various mixers, known in the art, such as a tubular mixer, a Henschel mixer, a Nauter mixer, or a V-type mixer.

<<Developing Agents>>

The toner of the present invention may be used either as a single component developing agent or a double component developing agent.

When employed as a single component developing agent, listed is a non-magnetic or magnetic single component developing agent.

The toner of the present invention can be employed as a double component developing agent by blending it with a carrier. In this case, employed as magnetic particles of the carrier are conventional materials, known in the art, such as metals including iron, ferrites, or magnetites and alloys of these metals with metals such as aluminum or lead. Of these, ferrite particles are particularly preferred. The volume average particle diameter of the aforesaid magnetic particles is preferably 15–100 μm, and is more preferably 25–80 μm.

The volume average particle diameter of carriers can be determined employing a laser diffraction type particle size distribution measurement apparatus "HELOS" (manufactured by SYMPATEC Co.), fitted with a wet type homogenizer, as a representative apparatus.

Preferred carriers include those in which each of the magnetic particles is further coated with resins, as well as so-called resin dispersion type carriers prepared by dispersing magnetic particles into resins. Coating resinous compositions are not particularly limited, and for example, olefin based resins, styrene based resins, styrene-acryl based resins, silicone based resins, ester based resins, or fluorine-containing polymer based resins are employed. Further, resins for constituting the resin dispersion type carriers are not particularly limited, and it is possible to use any of those known in the art. For example, employed may be styrene-acryl based resins, polyester resins, fluorine based resins, and phenol based resins.

The toner of the present invention is fixed employing an image forming method and an image forming apparatus comprising a fixing process achieved by a heat fixing unit.

Initially, one example of the image forming method and the image forming apparatus of the present invention will now be described.

FIG. 1 is a schematic view of the image forming apparatus showing one example of the embodiment of the present invention. Numeral 4 is a photoreceptor which is a representative example of the electrostatic latent image forming boy in the present invention. The photoreceptor is prepared by forming an organic photoconductive (OPC) material as a photosensitive material layer on the peripheral surface of an aluminum drum substrate, which rotates at a specified rate in the arrowed direction. In the example of the present embodiment, the external diameter of photoreceptor 4 is 60 mm.

In FIG. 1, exposure light is emitted from semiconductor laser beam source 1, based on information read by an original document reading unit (not shown). The emitted light is divided in the vertical direction with respect to the paper plane in FIG. 1 and is irradiated onto the photoreceptor surface via fθ lens 3 which corrects image deformation, whereby an electrostatic latent image is formed. In advance, the photoreceptor is uniformly charged employing charging unit 5 and starts rotating clockwise while synchronized with image exposure.

The latent image on the photoreceptor surface is developed employing development unit 6 and the resulting developed image is transferred onto synchronously conveyed recording material 8 by the action of transfer unit 7. Further, photoreceptor 4 and transfer material 8 are separated by separation unit (separation pole) 9. Subsequently, the developed toner image is transferred to and carried by transfer material 8, led to fixing unit 10, and then fixed.

Any non-transferred toner which remains on the photoreceptor surface is removed by cleaning unit 11, being a cleaning blade system, and residual charge is eliminated by pre-charging light exposure (PCL) 12 and is uniformly re-charged by charging unit 5 for the subsequent image formation.

Incidentally, representative transfer materials are sheets of plain paper. However, they are not particularly limited as long as unfixed images after development are transferable. It goes without saying that PET base sheets for OHP and the like are also included.

Further, cleaning blade 13 is comprised of an elastic rubber material of a thickness of about 1—about 30 mm, and urethane rubber is most frequently used as such material. Cleaning blade 13 is used while brought into contact with the photoreceptor whereby heat is easily transmitted. Subsequently, when image formation is not performed, it is desirous that it is kept away from the photoreceptor.

In recent years, in the electrophotographic field in which electrostatic latent images are formed on a photoreceptor and the resulting latent images are developed to prepare visible images, research and development for image forming methods utilizing digital systems, which are capable of easily achieving improvement of image quality, conversion, and edition and forming high quality images, has increasingly been conducted.

As optical scanning systems in which photo-modulation is performed based on digital image signals from a computer employed in the aforesaid image forming method and apparatus as well as original documents for copying, there are apparatuses which directly modulate laser intensity, employing (1) an apparatus in which an acousto-optic modulator is arranged in a laser optical system so that photo-modulation is performed by the aforesaid acousto-optical modulator, and (2) an apparatus in which a semiconductor laser is employed and the laser intensity is directly modulated. Spot exposure is carried out onto a uniformly charged photoreceptor from these scanning optical systems, whereby images comprised of dots are formed.

The beam emitted from the aforesaid scanning optical system results in a circular or elliptical luminance distribution similar to the normal distribution having a broad spread on both sides. For example, in the case of a laser beam, commonly formed is a very small circular or elliptical shape of 20–100 μm in either the primary scanning direction or the secondary direction, or in both directions.

Further, it is possible to modify the aforesaid image forming apparatus so that a processing cartridge is installed in which at least one of photoreceptor 4, charging unit 5, development unit 6, cleaning unit 11, or transfer unit 7 is incorporated.

Figure 2:
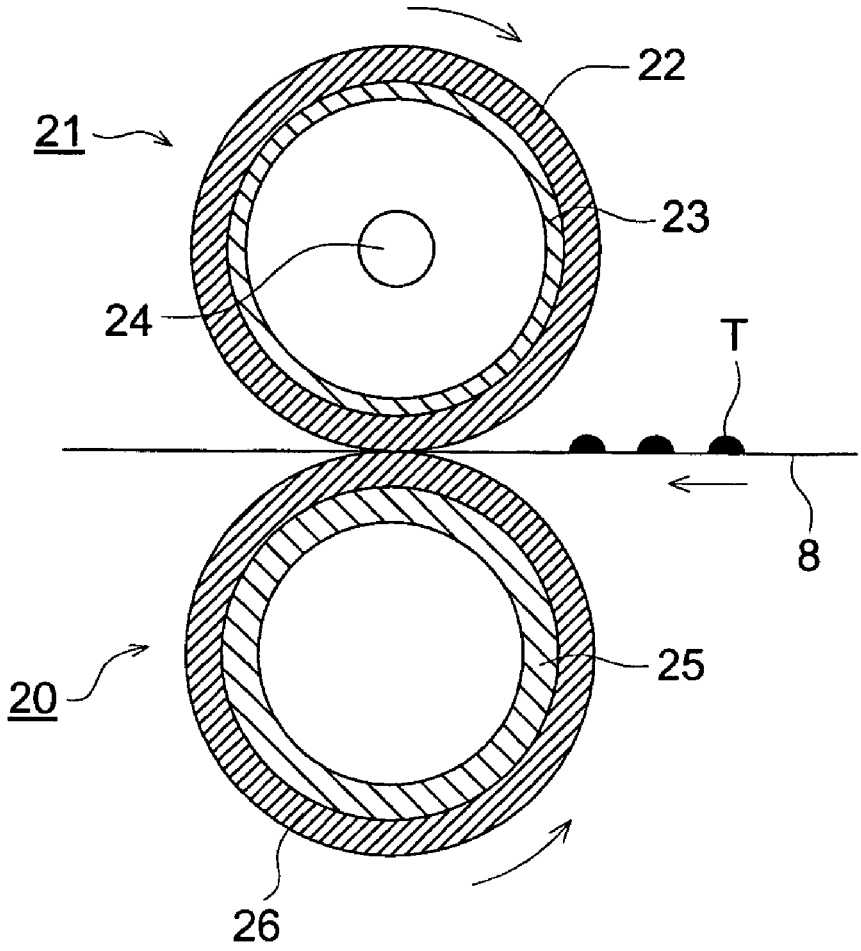
FIG. 2 is a sectional view showing one example of a fixing unit employed in the image forming apparatus of the present invention.

FIG. 2 is a sectional view showing one example of the fixing unit used in an image forming method employing the toner of the present invention. The fixing unit shown in FIG. 2 is comprised of heating roller 21 and pressure roller 20, which is brought into contact with it. Further, in FIG. 2, T is a toner image formed on transfer material 8 (being an image forming support).

In heating roller 21, covering layer 22 comprised of fluorine resins or elastic materials is formed on the surface of core cylinder 23 which includes heating member 24 comprised of a linear heater.

Core cylinder 23 is comprised of metal and its inner diameter is specified to be 1–70 mm. Metals which constitute core cylinder 23 are not particularly limited and examples include metals such as iron, aluminum, or copper, or alloys thereof.

The wall thickness of core cylinder 23 is specified to be 0.1–15 mm and decided while considering the balance required for saving energy (a decrease in thickness) and maintaining strength (depending on constituting materials). For example, when strength of a 0.57 mm thick iron cylinder is to equal that by employing an aluminum cylinder, it is necessary to increase the thickness of the aluminum cylinder to 0.8 mm.

Exemplified as fluorine resins which constitute of the surface layer of covering layer 22 may be PTFE (polytetrafluoroethylene) and PFA (tetrafluoroethylene-perfluoroalkyl vinyl ether copolymers).

The thickness of the surface layer of covering layer 22 comprised of fluorine resins is specified to commonly be 10–500 μm, and preferably 20–400 μm.

When the thickness of the surface layer of covering layer 22 comprised of fluorine resins is less than 10 μm, it is not possible to sufficiently exhibit desired functions of the covering layer, whereby it is not possible to ensure durability as a fixing unit. On the other hand, a 500 μm or thicker surface layer of the covering layer tends to result in abrasion due to paper dust, which results in adhesion of toner on abraded spots, whereby staining problems occur on images.

Further, as an elastic body constituting covering layer 22, it is preferable to use silicone rubber such as LTV, RTV, or HTV, or silicone sponge rubber with the desired heat resistance.

The Asker C hardness of the elastic body constituting covering layer 22 is specified to be less than 80 degrees and preferably less than 60 degrees.

Further, the thickness of covering layer 22 is specified to be 0.1–30 mm and preferably 0.1–20 mm.

When the Asker C hardness of the elastic body constituting covering layer 22 exceeds 80 degrees, and the thickness of the aforesaid covering layer is less than 0.1 mm, it is not possible to increase the fixing nip, whereby it is not possible to exhibit soft fixing effects (for example, color reproduction enhancing effects due to the toner layer on the smoothed interface).

Suitably employed as heating member 24 may be a halogen heater.

Pressure roller 20 is structured in such a manner that covering layer 26 comprised of elastic materials is formed on the surface of core cylinder 25. Elastic materials which constitute covering layer 26 are not particularly limited, and various soft kinds of rubber such as urethane rubber or silicone rubber as well as sponge rubber may be listed. It is preferable to use silicone rubber and silicone sponge rubber which are exemplified as a material to constitute covering layer 26.

The Asker C hardness of elastic materials to constitute covering layer 26 is specified to be less than 80 degrees, preferably less than 70 degrees, and more preferably less than 60 degrees.

Further, the thickness of covering layer 26 is specified to be 0.1–30 mm and preferably 0.1–20 mm.

When the Asker C hardness of elastics materials to constitute covering layer 26 exceeds 80 degrees and the thickness of covering layer 26 is 0.1 mm, it is not possible to increase the fixing nip, whereby, it is not possible to exhibit soft fixing effects.

Materials to constitute core cylinder 25 are not particularly limited, and metals such as aluminum, iron, or copper as well as alloys thereof may be listed.

A contact load (being a total load) between heating roller 21 and pressure roller 20 is specified to be customarily 40–350 N, preferably 50–300 N, and more preferably 50–250 N. The aforesaid contact load is specified while considering the strength (the wall thickness of core cylinder 23) of heating roller 21. For example, in the case of a heating roller having a 3 mm iron core cylinder, the contact load is preferably specified to be at most 250 N.

Further, in view of offsetting resistance and fixability, the nip width is preferably 4–10 mm, while the contact pressure of the aforesaid nip is preferably $0.6\times10^5$–$1.5\times10^5$ Pa.

When the fixing unit shown in FIG. 2 is employed, one example of fixing conditions is that fixing temperature (the surface temperature of heating roller 21) is specified to be 150–210° C., and the linear fixing rate is specified to be 80–640 mm/second.

If desired, a fixing unit may be provided with a cleaning mechanism. In such a case, employed as such a system, in which silicone oil is fed onto an upper roller (being a heating roller) of the fixing section, may be a method in which cleaning is carried while fed with silicone oil impregnated pads, rollers or webs.

Employed as types of silicone oil are those with high heat resistance, and polydimethylsilicone, polyphenylmethylsilicone, and polydiphenylsilicone are employed. Since types of silicone oil with a relatively low viscosity result in an increase in the outflow, types with a viscosity of 1–100 Pa·s at 20° C. are suitably employed.

However, effects of the present invention are markedly exhibited when a process is included in which images are formed employing a fixing unit to which no silicone oil is fed or only an extremely small amount of silicone oil is fed. Consequently, even when silicone oil is fed, it is preferable that the feeding amount is controlled to be at most 2 mg per A4 paper sheet.

Further, it is possible to avoid the generation of problems such as a decrease in offsetting resistance due to modification of silicone oil during use as well as staining of optical systems and charging poles by silicone oil.

The fed amount of silicone oil is calculated based on ($\Delta w/100$) in the following manner. One hundred transfer sheets (A4 size white sheets of paper) are continuously passed through a fixing unit (between rollers) heated at a specified temperature and the weight difference ($\Delta w$) of the fixing unit prior to and after passage of the sheets is determined.

EXAMPLES

The present invention will now be detailed with reference to examples. Needless to say, however, the present invention is not limited thereto. "Parts", as described herein, refers to "weight parts".

Production Example of Resinous Particles for Toner (Latex (1HML))

(1) Preparation of Nucleus Particles (First Stage Polymerization)

Charged into a 5,000 ml separable flask fitted with a stirring unit, a thermal sensor, a cooling pipe, and a nitrogen feeding unit, was a surface active agent solution (being a water-based medium) which was prepared by dissolving 7.08 g of an anionic surface active agent (101) in 3,010 g of ion-exchange water, and while stirring at 230 rpm, the contents of the flask was heated to 80° C. under a flow of nitrogen.

$$C_{10}H_{21}(OCH_2CH_2)_2OSO_3Na \quad (101)$$

Added to the aforesaid surface active agent solution was an initiator solution which was prepared by dissolving 9.2 g of a polymerization initiator (potassium persulfate: KPS) in 200 g of ion-exchange water. After raising the temperature to 75° C., a monomer mixed liquid composition comprised of 70.1 g of styrene, 19.9 g of n-butyl acrylate, and 10.9 g of methacrylic acid was dripped over a period of one hour, and the resulting system underwent polymerization (first stage polymerization) for two hours while stirred and heated at 75° C., whereby a latex (a resinous particle dispersion comprised of high molecular weight resins) was prepared. The resulting latex was designated as "Latex (1H)".

(2) Formation of Interlayer (Second Stage Polymerization)

Added to a monomer mixed liquid composition comprised of 105.6 g of styrene, 30.0 g of n-butyl acrylate, 6.2 g of methacrylic acid, and 5.6 parts by weight of n-octyl-3-mercaptopropionic acid ester, charged into a flask fitted with a stirring unit, were 98.0 g of the compound (hereinafter referred to as "Exemplified Compound 19)" represented by aforesaid Compound 19) as a release agent and dissolved while heated to 90° C., whereby a monomer solution was prepared.

On the other hand, a surface active agent solution prepared by dissolving 1.6 g of an anionic surface active agent (the aforesaid (101)) in 2,700 ml of ion-exchange water was heated to 98° C., and then added with 28 g at solid conversion of aforesaid Latex (1H) which was a dispersion of nucleus particles. Thereafter, the aforesaid monomer solution of Exemplified Compound 19) was mixed and dispersed for 8 hours, employing a mechanical homogenizer "CLEARMIX" (manufactured by M-Technique Co. Ltd.) employing a circulation path, whereby a dispersion comprised of emulsified particles (oil droplets) was prepared.

Subsequently, an initiator solution prepared by dissolving 5.1 g of a polymerization initiator (KPS) in 240 ml of ion-exchange water and 750 ml of ion-exchange water were added to the resulting dispersion. The resulting system underwent polymerization (a second stage polymerization) while stirred at 98° C. over a period of 12 hours, whereby a latex (being a dispersion comprising composite resinous particles in such a structure that the surface of the resinous particles comprised of high molecular weight resins is covered with medium molecular weight resins) was prepared. The resulting latex was designated as "Latex (1HM).

(3) Formation of Outer Layer (Third Stage Polymerization)

Added to Latex (1HM) prepared as above was an initiator solution prepared by dissolving 7.4 g of a polymerization initiator (KPS) in 200 ml of ion-exchange water, and a monomer mixed liquid composition comprised of 300 g of styrene, 95 g of butyl acrylate, 15.3 g of methacrylic acid, and 10.4 g of n-octyl-3-mercaptopropionic acid ester was dripped at 80° C. over a period of one hour. After completion of dripping, the resulting mixture underwent polymerization (third stage polymerization) while stirring for two hours, and then was cooled to 28° C., whereby a latex (being a dispersion of composite resinous particles which have a central portion comprised of high molecular weight resins, an interlayer comprised of medium molecular weight, and an outer layer comprised of low molecular weight resins in which Exemplified Compound 19) was incorporated into the aforesaid interlayer) was prepared. The resulting latex was designated as "Latex (1HML)".

The composite resinous particles constituting aforesaid Latex (1HML) had peaks of molecular weight of 138,000, 80,000, and 13,000, and the weight average particle diameter of the resulting composite resinous particles was 122 nm.

(Latex (2HML))

A latex (being a dispersion of composite resinous particles which have a central portion comprised of high molecular weight resins, an interlayer comprised of medium molecular weight resins, and an outer layer comprised of low molecular weight resins) was prepared in the same manner as Latex (1HML), except that Anionic Surface Active Agent (101) was replaced with an anionic surface active agent (sodium dodecylbenznesulfonate: SDS) in an amount of 7.08 g. The resulting latex was designated as "Latex (2HML)".

The composite resinous particles constituting aforesaid Latex (2HML) had peaks of molecular weight of 138,000, 80,000, and 12,000, and the weight average particle diameter of the resulting composite resinous particles was 110 nm.

(Production of Toner 1)

Dissolved in 1,600 ml of ion-exchange water were 59.0 g of anionic surface active agent (101), and 420.0 g of carbon black "Regal 330" (manufactured by Cabot Co.) were gradually added to the resulting solution. Subsequently, the resulting mixture was dispersed employing "CLEARMIX" (manufactured by M-Technique Co.), whereby a colorant particle dispersion (hereinafter referred to as "Colorant Dispersion 1") was prepared. The diameter of the colorant particles in the aforesaid colorant dispersion was determined employing a electrophoresis light scattering photometer "ELS-800" (manufactured by Otsuka Electronics Co., Ltd.), resulting in a weight average particle diameter of 89 nm.

Placed in a reaction vessel (a four-necked flask) fitted with a thermal sensor, a cooling pipe, a nitrogen inlet unit, and a stirring unit were 420.7 g of Latex (1HML), 900 g of ion-exchange water, and 166 g of Colorant Dispersion 1, and the resulting mixture was stirred. After adjusting the interior temperature of the vessel to 30° C., the pH of the resulting solution was adjusted to 9.0 by the addition of a 5 mol/1,000 ml sodium hydroxide aqueous solution.

Subsequently, while stirring, an aqueous solution prepared by dissolving 12.1 g of magnesium chloride hexahydrate in 1,000 ml of ion-exchange water was added at 30° C. over a period of 10 minutes. After allowing the resulting mixture to stand for 3 minutes, the temperature was raised. The resulting system was heated to 70° C. over a period of 3 minutes, whereby salting-out/coalesced particles were formed. In such a state, the equivalent circular diameter and average circularity particle diameter of coalesced particles was determined employing an FPIA-2100. When these reached the specified values, growth of the particles was retarded by the addition of an aqueous solution prepared by dissolving 2 g of sodium chloride in 1,000 ml of ion-exchange water. Thereafter, growth of 0.2–1.0 μm was carried out to result in the desired gradient of circularity to the equivalent circular diameter. Further, as a ripening treatment, the resulting liquid composition was heated while stirring at 90° C. for only 2 minutes, whereby particle coalescence was allowed to continue (being a ripening process).

Thereafter, the resulting composition was cooled to 30° C., and the pH was adjusted to 2.0 by the addition of hydrochloric acid and stirring was terminated. The resulting salted-out/coalesced particles were collected by filtration and were repeatedly washed with ion-exchange water at 40° C. Thereafter, the washed particles were dried employing 40° C. air flow and were blended with 0.8 part by weight of hydrophobic silica and 1.0 part by weight of hydrophobic titanium oxide over a period of 25 minutes, employing a 10,000 ml Henschel mixer in which the peripheral rate of rotary blades was set at 30 m/second, whereby Toner 1 was prepared.

(Production of Toners 2–4)

In the production of Toner 1, Latex (1HML) was replaced with Latex (2HML). During formation of salted-out/coalesced particles, when the equivalent circular diameter and the average circularity reached 2.5 μm and 0.987, respectively, growth of the particles was terminated by the addition of an aqueous solution prepared by dissolving 8 g of sodium chloride in 100 ml of ion-exchange water. Further, as a ripening treatment, heating and stirring were carried out at a liquid temperature of 90° C. over a period of 20 minutes to continue coalescence of the particles, whereby a colored particle dispersion was prepared. The resulting colored particle dispersion was designated as Dispersion S. On the other hand, during formation of coalesced particles, when the equivalent circular diameter and average circularity of the coalesced particles reached 7.8 μm and 0.875, respectively, growth of the particles was terminated in the same manner as above by the addition of an aqueous solution prepared by dissolving 80 g of sodium chloride in 1,000 ml, whereby Colored Particle Dispersion L was prepared. Subsequently, while monitoring the equivalent circular diameter and average circularity particle diameter of the coalesced particles employing an FPIA-2100, Colored Particle Dispersion S and Colored Particle Dispersion L were blended. Subsequently, the resulting mixture was cooled to 30° C. The pH was then adjusted to 2.0 by the addition of hydrochloric acid, and stirring was terminated. The resulting coalesced particles were collected by filtration and were repeatedly washed with ion-exchange water at 40° C. Thereafter, the washed particles were dried employing 40° C. air flow and were blended with 0.8 part by weight of hydrophobic silica and 1.0 part by weight of hydrophobic titanium oxide over a period of 25 minutes, employing a 10,000 ml Henschel mixer of which peripheral rate of its rotary blades was set at 30 m/second, whereby Toners 2–5, shown in Table 1, were prepared.

(Production of Comparative Toner 1)

Placed in a reaction vessel (a four-necked flask) fitted with a thermal sensor, a cooling pipe, a nitrogen feeding unit, and a stirring unit were 420.7 g (converted as solids) of Latex (1HML), 900 g of ion-exchange water, and 166 g of Colorant Dispersion 1, and then the resulting mixture was stirred. After adjusting the interior temperature of the vessel to 30° C., the pH of the resulting solution was adjusted to 9.0 by the addition of a 5 mol/1,000 ml sodium hydroxide aqueous solution.

Subsequently, while stirring, an aqueous solution prepared by dissolving 12.1 g of magnesium chloride hexahydrate in 1,000 ml of ion-exchange water was added at 30° C. over a period of 10 minutes. After allowing the resulting mixture to stand for 3 minutes, the temperature was raised. The resulting system was heated to 90° C. over a period of 60 minutes, whereby coalesced particles were allowed to grow. In such a state, the diameter of coalesced particles was determined employing a "Coulter Counter TA-II". When the number average particle diameter reached 3.5 μm, growth of the particles was terminated by the addition of an aqueous solution prepared by dissolving 80.4 g of sodium chloride in 1,000 ml of ion-exchange water. Further, as a ripening treatment, heating and stirring were carried out at a liquid temperature of 98° C. over a period of 12 hours, whereby particle coalescence, as well as the phase separation of crystalline substances, was allowed to continue (being a ripening process).

Thereafter, the resulting composition was cooled to 30° C., and the pH was adjusted to 2.0 by the addition of hydrochloric acid and stirring was terminated. The resulting coalesced particles were collected by filtration and were repeatedly washed with ion-exchange water at 45° C. Thereafter, the washed particles were dried employing 40° C. air flow and were blended with 0.8 part by weight of hydrophobic silica and 1.0 part by weight of hydrophobic titanium oxide for 25 minutes, employing a 10,000 ml Henschel mixer of which peripheral rate of its rotary blades was set at 30 m/second, whereby Comparative Toner 1 was prepared.

Subsequently, Comparative Toners 2–4 were prepared by controlling the aforesaid ripening process temperature and the processing time.

Table 1 shows the average circularity, the average of the equivalent circular diameter, and the gradient of the circularity to the equivalent circular diameter of each of Toners 1–5 and Comparative Toners 1–4, prepared as above.

TABLE 1

| | Average Circularity | Average Equivalent Circular Diameter | Gradient of Circularity to Equivalent Circular Diameter | $d_{90}/d_{10}$ | $R^2$ |
|---|---|---|---|---|---|
| Example 1 | 0.96 | 4.4 | −0.0031 | 1.61 | 0.90 |
| Example 2 | 0.95 | 6.4 | −0.0038 | 1.71 | 0.85 |
| Example 3 | 0.97 | 3.5 | −0.0021 | 1.41 | 0.65 |
| Example 4 | 0.95 | 7.3 | −0.0047 | 1.76 | 0.48 |
| Example 5 | 0.98 | 2.7 | −0.0014 | 1.25 | 0.41 |
| Comparative Example 1 | 0.96 | 5.3 | −0.000 | 1.56 | 0.00 |
| Comparative Example 2 | 0.97 | 4.5 | −0.006 | 1.41 | 0.65 |
| Comparative Example 3 | 0.98 | 4.8 | −0.006 | 1.76 | 0.32 |
| Comparative Example 4 | 0.96 | 5.1 | −0.006 | 1.58 | 0.98 |

Production of Carrier

Production of Ferrite Core Materials

In a wet type ball mill, 18 mol percent of MnO, 4 mol percent of MgO, and 78 mol percent of $Fe_2O_3$ were crushed and mixed for two hours and dried. Thereafter, the resulting mixture was maintained at 900° C. for two hours to be subjected to preliminary burning and was crushed for 3 hours in a ball mill to form a slurry. Subsequently, dispersing agents and binders were added and the resulting mixture was granulated employing a spray drier, followed by drying. Thereafter, the main burning was carried out at 1,200° C. for 3 hours, whereby ferrite core martial particles of a resistance value of $4.3\times10^8$ Ω·cm were prepared.

Production of Covering Resins

Initially, a cyclohexyl methacrylate/methyl methacrylate copolymer (at a copolymerization ratio of 5/5) was synthesized in an aqueous solution media comprising sodium benzenesulfonate having an alkyl group with 12 carbon atoms as a surface active agent at a concentration of 0.3 percent by weight, by employing an emulsion polymerization method. Thus, prepared were minute resinous particles at a volume average primary particle diameter of 0.1 mm, a weight average molecular weight (Mw) of 200,000, a number average molecular weight (Mn) of 91,000, an Mw/Mn of 2.2, a softening point temperature (Tsp) of 230° C., and a glass transition temperature (Tg) of 110° C. Incidentally, the amount of residual monomers was adjusted to 510 ppm while forming an azoetrope of the aforesaid resinous particles at an emulsified state with water.

Subsequently, charged into a high speed stirring mixer fitted with stirring blades were 100 parts by weight of ferrite core material particles and 2 parts by weight of the aforesaid resinous particles and mixed while stirring at 120° C. for 30 minutes, whereby resin-coated carrier of a volume average particle diameter of 62 μm was prepared utilizing mechanical impact force.

Production of Developing Agent

The colored particles added with external additives were blended with the carrier, whereby a developing agent at a toner concentration of 6 percent by weight was prepared.

Production of Photoreceptor P1

The liquid coating composition described below was applied onto a 60 mm diameter electrically conductive cylindrical support of a length of 380 mm.

| <Sublayer> | |
|---|---|
| Titanium chelate compound (TC-750, manufactured by Matsumoto Chemical Industry Co., Ltd.) | 30 g |
| Silane coupling agent (KMB-503, manufactured by Shin-Etsu Chemical Co., Ltd.) | 17 g |
| 2-Propanol | 150 ml |

The aforesaid liquid coating composition was applied onto an electrically conductive cylindrical support to result in a layer thickness of 0.5 μm.

| <Charge Generating Layer> | |
|---|---|
| Y type titanyl phthalocyanine (being phthalocyanine having a maximum peak at 27.2 degrees at Bragg angle of 2θ (±0.2 degree) under Cu-Kα characteristic X-ray diffraction spectra measurement) | 60 g |
| Silicone modified butyral resin (X-40-1211M, manufactured by Shin-Etsu Chemical Co., Ltd.) | 700 g |
| 2-Butanone | 2000 ml |

were mixed and the resulting mixture was dispersed for 10 hours employing a sand mill, whereby a charge generating layer liquid coating composition was prepared.

The aforesaid liquid coating composition was applied onto the aforesaid sublayer employing a dip coating method, whereby a 0.2 μm thick charge generating layer was formed.

| <Charge Transport Layer> | |
|---|---|
| Charge transport material N-(4-methylphenyl)-N-{4-β-phenylstyryl}phenyl}-p-toluidine | 225 g |
| Polycarbonate (at a viscosity average molecular weight of 30,000) | 300 g |
| Antioxidant (Exemplified Compound 1–3) | 6 g |
| Dichloromethane | 2000 ml |

were mixed and dissolved, whereby a charge transport layer liquid coating composition was prepared. The resulting liquid coating composition was applied onto the aforesaid charge generating layer employing a dip coating method, whereby a charge transport layer of a dried layer thickness of 20 μm was formed.

| <Protective Layer> | |
|---|---|
| Methyltrimethoxysilane | 150 g |
| Dimethyldimethoxysilane | 30 g |
| Reactive charge transport compound | 15 g |
| Polyvinylidene fluoride particles (at a volume average particle diameter of 0.2 μm) | 10 g |
| Antioxidant | 0.75 g |
| 2-Propanol | 75 g |
| 3 percent acetic acid | 5 g |

were mixed, whereby a resinous layer liquid coating composition was prepared. The resulting liquid coating composition was applied onto the aforesaid charge transport layer to form a 2 μm thick resinous layer, employing a circular amount controlling type coater, and the resulting coating was thermally cured at 120° C. for one hour to form a siloxane resinous layer, whereby Photoreceptor P1 was prepared.

Photoreceptor P1 and each of the developing agents were installed in a digital copier (comprising corona charging, laser exposure, reversal development, electrostatic transfer, claw separation, and cleaning blades), employed for evaluation, which comprised the image forming processes shown in FIG. 1, and were evaluated.

Charging Condition

Charging unit: Scorotron charging unit, at an initial charging potential of −750 V Exposure Condition The exposure amount was set to result in an electric potential of the exposure section of −50 V.

Development Conditions

DC bias: −550 V

Transfer pole: corona transfer system

Further, employed as a fixing unit were a combination of a heating roller at surface roughness Ra of 0.8 μm comprised of an iron core cylinder of which surface was covered with a 25 μm thick PFA (a tetrafluoroethylene-perfluoroalkyl vinyl ether copolymer) and a pressure roller at surface roughness Ra of 0.8 μm comprised of an iron core cylinder which was covered with HTV silicone rubber which was further covered with a 120 μm thick PFA tube. Incidentally, the nip width was 3.8 mm and the linear rate was 420 mm/second.

Further, neither a cleaning mechanism nor a silicone oil feeding mechanism of the fixing unit was installed. Fixing temperature was controlled by the surface temperature of the heating roller, and the temperature was set at 165° C.

Copying conditions were as follows. At low temperature and low humidity (10° C. and 20 percent relative humidity) 1,000,000 sheets were continuously copied, and offsetting resistance of copied images, staining during image formation, standard glossiness, cleaning properties, and filming generation of the photoreceptor were evaluated based on the evaluation criteria below.

An original document, having four equal quarters of a text image at a pixel ratio of 7 percent, a human portrait image, a solid white image, and a solid black image, was copied employing A4 neutralized paper sheets. At every 10,000th sheet, the halftone, solid white image, solid black image and fine line image were evaluated.

After continuously printing the original document onto 1,000 A4 size transfer sheets, a non-image sheet was printed, and the generation of staining onto the white sheet due to offsetting and toner stain on the surface of the heating roller were visually evaluated. Incidentally, employed as a transfer sheet used for the evaluation was a high quality 200/g thick paper sheet and a line image of a width of 0.3 mm and a length of 150 mm parallel to the sheet advancing direction (the heating roller peripheral direction) was formed.

A: neither image offsetting on the white sheet nor toner staining on the heating roller was noted B: image offsetting on the white sheet was not noted but toner staining on the heating roller was noted C: image offsetting on the white sheet was clearly noted Evaluation ranks A and B were commercially viable but evaluation rank C was not.

Evaluation of Fixable Temperature Range

Fixed images were formed while varying the temperature of the heating roller from 130 to 240° C. at an interval of 10° C. Incidentally, fixed images were outputted employing plain A4 size paper sheets (at a basis weight of 64 g/m$^2$).

Herein, evaluation was carried out based on the criteria below.

A: excellent; the fixable temperature was at least 100° C.

B: good; the fixable temperature was at least 70—less than 100° C.

C: commercially viable; the fixable temperature was at least 40—less than 70° C.

D: poor; the fixable temperature was less than 40° C.

Halftone Uniformity

The uniformity of halftone images which depended on transferability variation after the aforesaid continuous 1,000,000 copies was evaluated.

Evaluation was carried out based on the ranks below.

A: uniform image with no unevenness

B: the presence of extremely slight streaked unevenness

C: the presence of several lines of slight streaked Unevenness, however at a commercially viable level D: the presence of several lines of obvious streaked unevenness Minute Spots Around Dots An entire image was formed employing a 10 percent dot image and minute spots around the dots were observed employing a hand magnifier. Evaluation was carried out based on the criteria below.

A: no minute spots were noted

B: only when very carefully observed, slight minute spots were noted

C: minute spots were obviously noted

Further, at every 10,000th copy, the photoreceptor surface and the development roller surface were visually observed, and the observed results of toner filming to the photoreceptor and toner filming to development roller were recorded.

TABLE 2

| | Offsetting Resistance | Fixable Temperature Range | Halftone Uniformity | Minute Spots around Dots | Toner Filming on Photo-receptor | Toner Filming on Development Roller |
|---|---|---|---|---|---|---|
| Example 1 | A | A | A | A | no formation until the 1,000,000 sheet run | no formation until the 1,000,000 sheet run |
| Example 2 | A | B | B | A | no formation until the 1,000,000 sheet run | no formation until the 1,000,000 sheet run |
| Example 3 | A | B | B | A | no formation until the 1,000,000 sheet run | no formation until the 1,000,000 sheet run |
| Example 4 | A | C | B | A | no formation until the 1,000,000 sheet run | no formation until the 1,000,000 sheet run |
| Example 5 | A | C | B | B | no formation until the 1,000,000 sheet run | no formation until the 1,000,000 sheet run |
| Comparative Example 1 | C | D | D | C | formation by the 200,00th sheet | formation by the 200,00th sheet |
| Comparative Example 2 | C | D | D | C | formation by the 50,000th sheet | formation by the 50,000th sheet |
| Comparative Example 3 | C | D | D | C | formation by the 20,000th sheet | formation by the 20,000th sheet |
| Comparative Example 4 | C | D | D | C | formation by the 20,000th sheet | formation by the 20,000th sheet |

As can clearly be seen from Table 2, Examples 1–5 of the present invention exhibited excellent characteristic for each evaluation item, while Comparative Examples 1–4 beyond the present invention resulted in problems.

According to the present invention, even though a heating roller fixing system is employed in combination with a polymerization method toner in which the diameter of toner particles is relatively small, and the particle size distribution and the particle shape are uniform, it is possible to provide toner for developing electrostatic latent images which is sufficiently deformed to conform to the unevenness of paper sheets and the heating roller surface, and is capable of forming high quality images while minimizing insufficient fixing, and an image forming method as well as an image forming apparatus using the same.

What is claimed is:

1. A toner for developing an electrostatic latent image, comprising: average circularity of 0.94–0.98, the average value of equivalent circular diameter of 2.6–7.4 μm, and the gradient of the circularity to the equivalent circular diameter of from −0.005 to −0.001.

2. The toner of claim 1, wherein said average value of equivalent circular diameter is 3.4–6.6 μm.

3. The toner of claim 2, wherein the square of R obtained by the formula below is 0.35–0.95, $$R = \frac{n(\sum XY) - (\sum X \sum Y)}{[n\sum X^2 - (\sum X)^2][n\sum Y^2 - (\sum Y)^2]}$$

wherein X represents the equivalent circular diameter and Y represents the circularity.

4. The toner of claim 1, wherein the gradient of the circularity to the equivalent circular diameter is from −0.004 to −0.002.

5. The toner of claim 4, wherein the square of R obtained by the formula below is 0.35–0.95, $$R = \frac{n(\sum XY) - (\sum X \sum Y)}{[n\sum X^2 - (\sum X)^2][n\sum Y^2 - (\sum Y)^2]}$$

wherein X is the equivalent circular diameter and Y is the circularity.

6. The toner of claim 1, wherein said average value of equivalent circular diameter is 3.4–6.6 μm and said gradient of the circularity to the equivalent circular diameter is from −0.004 to −0.002.

7. The toner of claim 6, wherein ratio $d_{90}/d_{10}$ is 1.2–1.8 where $d_{10}$ is the equivalent circular diameter at 10 percent accumulation and $d_{90}$ is the equivalent circular diameter at 90 percent accumulation.

8. The toner of claim 6, wherein the square of R obtained by the formula below is 0.35–0.95, $$R = \frac{n(\sum XY) - (\sum X \sum Y)}{[n\sum X^2 - (\sum X)^2][n\sum Y^2 - (\sum Y)^2]}$$

wherein X is the equivalent circular diameter and Y is the circularity.

9. The toner of claim 1, wherein ratio $d_{90}/d_{10}$ is 1.2–1.8 where $d_{10}$ is the equivalent circular diameter at 10 percent accumulation and $d_{90}$ is the equivalent circular diameter at 90 percent accumulation.

10. The toner of claim 1, wherein the toner is prepared by polymerizing at least a polymerizable monomer in a water-based medium.

11. The toner for developing an electrostatic latent image in claim 1, wherein the toner is prepared by salting-out and coalescing at least one type of resinous particles.

12. The toner of claim 1, wherein the BET specific surface area is 1.1–4.0 $m^2/g$, the amount of silicon atoms existing on the surface, determined by ESCA, is 6–12 percent by area and the amount of existing carbon atoms is 50–75 percent by area.

13. The toner of claim 1, wherein the square of R obtained by the formula below is 0.35–0.95, $$R = \frac{n(\sum XY) - (\sum X \sum Y)}{[n\sum X^2 - (\sum X)^2][n\sum Y^2 - (\sum Y)^2]}$$

wherein X is the equivalent circular diameter and Y is the circularity.

14. An image forming method, comprising steps of:

developing an electrostatic latent image formed on a photoreceptor employing the toner described in claim 1 to form a toner image, transferring said toner image onto a recording medium, and fixing said toner image.

15. The image forming method of claim 14, further comprising:

exposing onto said photoreceptor to form said electrostatic latent image, wherein exposure is achieved by digital exposure.

16. The image forming method of claim 14, wherein the fixing comprises passing said recording medium which carries the toner image, between a heating member and a pressure member.

17. The image forming method of claim 14, wherein the average value of equivalent circular diameter is 3.4–6.6 μm, and the gradient of the circularity to the equivalent circular diameter is from −0.004 to −0.002.

18. The image forming method of claim 14, wherein ratio $d_{90}/d_{10}$ is 1.2–1.8, where $d_{10}$ is the equivalent circular diameter at 10 percent accumulation and $d_{90}$ is the equivalent circular diameter at 90 percent accumulation.

19. The image forming method of claim 14 wherein the BET specific surface area is 1.1–4.0 $m^2/g$, the amount of silicon atoms existing on the surface, determined by ESCA, is 6–12 percent by area and the amount of existing carbon atoms is 50–75 percent by area.

20. The image forming method in claim 14 wherein the square of R obtained by the formula below is 0.35–0.95, $$R = \frac{n(\sum XY) - (\sum X \sum Y)}{[n\sum X^2 - (\sum X)^2][n\sum Y^2 - (\sum Y)^2]}$$

wherein X is the equivalent circular diameter and Y is the circularity.

* * * * *